United States Patent [19]

Skovsgaard

[11] Patent Number: 4,772,200

[45] Date of Patent: Sep. 20, 1988

[54] DENTAL WORKING STAND

[75] Inventor: Herluf V. Skovsgaard, Ryomgård, Denmark

[73] Assignee: A/S Flex Dental, Denmark

[21] Appl. No.: 20,755

[22] Filed: Mar. 2, 1987

[51] Int. Cl.[4] ..... A61G 15/00

[52] U.S. Cl. ..... 433/79; 433/77; 312/209

[58] Field of Search ..... 433/77, 79; 312/209, 312/251

[56] References Cited

U.S. PATENT DOCUMENTS

| | | | |
|---|---|---|---|
| 369,590 | 9/1887 | Claypool | 312/209 |
| 3,304,609 | 2/1967 | Horowitz et al. | 433/79 |
| 3,823,475 | 7/1974 | Heubeck | 433/77 |
| 3,844,633 | 10/1974 | Frederick | 312/209 |
| 4,026,026 | 5/1977 | Richardson | 433/77 |
| 4,042,287 | 8/1977 | Hallen | 312/209 |

FOREIGN PATENT DOCUMENTS

| | | | |
|---|---|---|---|
| 0422256 | 4/1967 | Switzerland | 312/209 |

*Primary Examiner*—Gene Mancene
*Assistant Examiner*—Adriene J. Lepiane
*Attorney, Agent, or Firm*—Robert J. Koch

[57] ABSTRACT

A dental working stand comprises a stationary working table with a lower cabinet forming an instrument module and/or an upper cabinet.

To facilitate the dentist's access to the lower and/or upper cabinet during sole working the lower and/or upper cabinet, respectively, are pivotal around a vertical axis from a first position in which the front of the cabinet faces the position of the dental nurse at the front of the working table to a second position in which the cabinet front faces a dentist's postion at one end of a patient's support.

6 Claims, 2 Drawing Sheets

DENTAL WORKING STAND

BACKGROUND OF THE INVENTION

1. Field of the Invention

This invention relates to a dental working stand comprising a stationary working table with a lower and/or an upper cabinet module.

2. Description of the Related Technology

In traditional dental treatments the dentist's work has most frequently been carried out assisted by a dental nurse who is positioned at the side of the patient's chair or support and opposite said working table with direct access to the instruments and accessories stored in the cabinet modules thereof, thereby being in a position to hand such instruments and materials to the dentist when they are needed during the dental treatment.

In the design of dental working stands efforts are continuously made to obtain the best possible working conditions for the dentist as well as the dental nurse so that the individual functions during a dental treatment may be effected quickly and safely and at the slightest possible physical stress for the dentist and the dental nurse.

This development has inter alia resulted in placing the patient in a lying or almost lying position on a patient support with adjustable height, the dentist and the nurse being usually placed opposite each other on either side of the patient's support aligned with the head of the patient, the working table being placed at the same side of the patient's support as the dental nurse.

For economical reasons efforts have further been made to make it possible to carry out relatively simple dental treatments, such as ordinary examinations, by sole working of the dentist, i.e. without the assistance of the dental nurse, who may be liberated to carry out other working functions.

In most known dental working stands such sole working requires the instruments needed during the treatment to be taken out beforehand and placed e.g. on an instrument table or an instrument tray in connection with the dental apparatus designed as a unit so as to be immediately accessible to the dentist without requiring him or her to move from the working position.

For use in sole working it is known, however, to design the dental nurse's working table as a mobile unit, e.g. a wheeled table which as a whole may be moved from its usual position at the dental nurse's working place to a position where the dentist himself/herself has access to the cabinet modules of the working table.

The above design restrains the possibilities of use of the working table for reasons of mobility, because the table cannot be connected with stationary devices, such as a handwash basin or the like requiring sanitary installations and may only with difficulty be combined with appliances requiring electrical power supply. Moreover, in the entire planning of the dental clinic it should be taken into account that the trolley working table must be able to be moved between said positions without too much trouble.

SUMMARY OF THE INVENTION

It is the object of the invention to provide a design of the working table which without the said drawbacks offers full possibility of changing between nurse assisted dental treatments and sole working so as to obtain in either situation ergonomically correct working positions for the dentist.

According to the invention a dental working stand is provided, comprising a patient's support and a stationary working table having an instrument module formed as a lower cabinet, preferably provided with pull-out drawers and/or pull-out trays, and/or an upper cabinet for storing instruments, consumption materials and other accessories necessary for usual dental treatments, said lower cabinet and/or upper cabinet, respectively, being pivotal about a vertical axis from a first position in which its front side faces a dental nurse position at the front side of the working table and at the one side of the patient's support, to a second position in which the cabinet faces a dentist's working position located at one end of the patient's support and one end of the working table.

The pivotal suspension of the lower or upper cabinets of the working table, or possibly both the lower and the upper cabinets in the manner outlined, entails that the instruments needed for ordinary dental treatments may be moved between positions where they are directly accessible for the dental nurse and the dentist, respectively, and simultaneously the working table as a whole is stationary and may thus be designed in an arbitrary size and be combined with additional, stationary appliances and, likewise, the planning of the dental clinic may be effected without any regard to the possibility of moving a trolley table.

BRIEF DESCRIPTION OF THE DRAWINGS

The invention will now be explained in more detail with reference to the schematical drawings, in which FIG. 1 in a layout form illustrates an example a dental working stand according to the invention.

DETAILED DESCRIPTION OF THE PREFERRED EMBODIMENT

Figure 1:
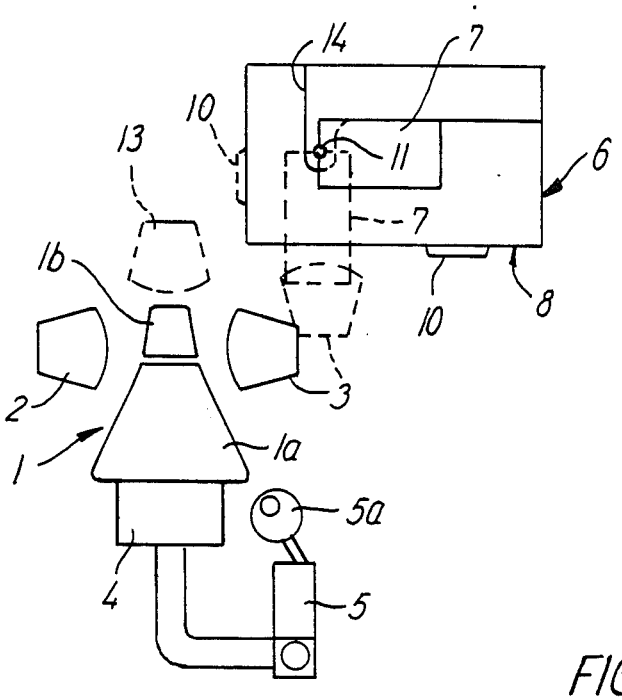

The layout drawing in FIG. 1 only illustrates the back supporting surface 1*a* and the head support 1*b* of a patient's support 1. During a dental treatment with the assistance of the dental nurse the dentist and the nurse will ordinarily occupy the positions 2 and 3, respectively, on either side of the head support 1*b*. An instrument table 4 is pivotally connected with a dental unit 5 and carries ordinary motor and pressurized gas driven dental instruments. A flushing fountain 5*a* is further connected with the unit 5 and adapted for use of the patient when the patient's support 1 is raised from the illustrated lying position to a sitting position.

A stationary working table 6 with a table top for use when entering in the journal, stirring of filling materials etc. is positioned opposite the usual position 3 of the dental nurse. The table 6 comprises an upper cabinet 7 and a lower cabinet 8 of which letter FIG. 1 shows only the handles 10 of a number of pull-out drawers of pull-out trays 9.

Figure 2:
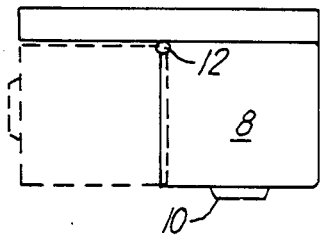
FIG. 2 is a section of FIG. 1 illustrating the lower cabinet of the working table.

As illustrated in FIG. 2 the lower cabinet 8 is constructed with a substantially square base and has in this example a lateral length corresponding substantially to half the length of the working table 6.

According to the invention the upper cabinet 7 and the lower cabinet 8 are individually pivotal about vertical axes 11 and 12, respectively, so that said cabinets may be moved from a first position, in which their fronts as illustrated in fully drawn cabinet markings in FIGS. 1 and 2 face the ordinary position 3 of the dental nurse opposite the front of the working table 6, to a second position in which the upper cabinet 7 and the lower cabinet 8 are moved 90° and face a place 13 illustrated in dotted lines in FIG. 1 and used by the dentist in sole working, i.e. without the assistance of the dental nurse.

In the first position of the upper cabinet 7 and the lower cabinet 8 the dental nurse has easy access to hand instruments, consumption materials and other accessories stored in the upper cabinet 7 or the lower cabinet 8 of the working table from her usual position. By pivoting the upper cabinet 7 and the lower cabinet 8 through 90° a corresponding easy access to such instruments and accessories is provided for the dentist when he/she occupies the position 13 for sole working.

As it appears from FIG. 2 the axis of rotation 12 for the lower cabinet 8 is located so that the front of the lower cabinet 8 in its first position is in alignment with the front of the working table 6 and in its second position is in alignment with the end of the working table 6 facing dentist's position 13.

As illustrated in FIG. 1 the upper cabinet 7 has a smaller length and width than the working table 6 and its axis of rotation 11 is located substantially centrally of the end of the upper cabinet 7 facing the patient's support 1 in the above mentioned first position. The axis of rotation 11 is moreover located so that in the first position the front of the upper cabinet 7 is retracted from the front of the working table 6 and in the second position is retracted from the end of the working table 6 facing the dentist's position 13. In order to place the upper cabinet 7 suitably opposite the dentist's position 13 in the second position, the axis of rotation 11 is further located so that it lies substantially centrally between the front and the back of the working table 6.

Figure 3:
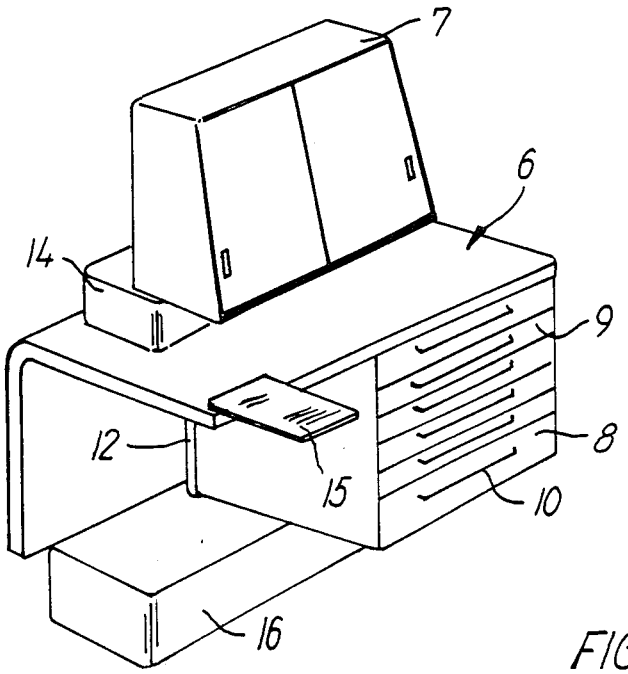
FIGS. 3 and 4 is an exemplified embodiment of the working table in FIG. 1 in a first and a second position, respectively.
Figure 4:
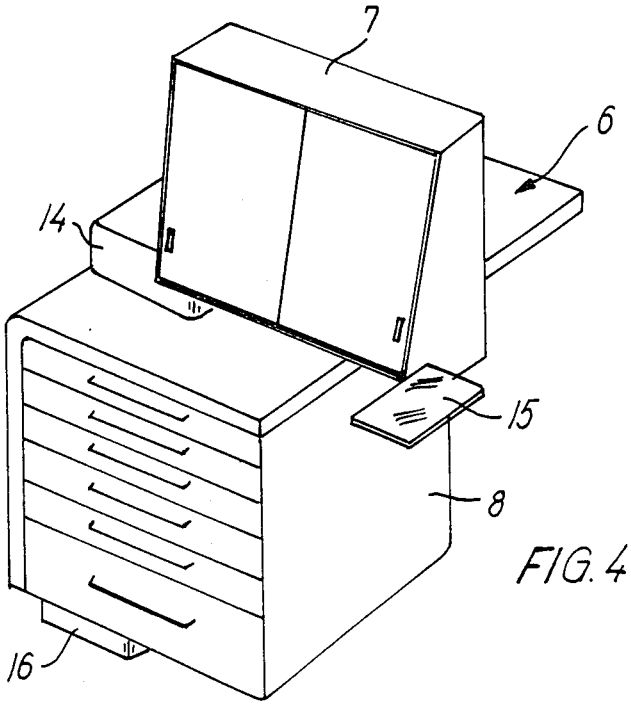

As it most clearly appears from the embodiment of the working table 6 illustrated in FIGS. 3 and 4, the upper cabinet 7 is positioned on a podium 14 on the tabletop of the working table. As illustrated in FIG. 1 said podium forms the back wall of the working table 6 between the tabletop thereof and the underside of the upper cabinet 7 in the first position. The axis of rotation 11 of the upper cabinet 7 is located at the end of the podium 14 facing the dentist's position 13 illustrated in FIG. 1.

As shown, the working table 6 may moreover at the end of the upper cabinet 7 which in the second position is positioned ahead of the dentist's position 13 towards the patient's support 1 be provided with a holder for a hand instrument table or plate 15. By placing the hand instrument plate 15 as illustrated in FIG. 4 the dentist has easy access to the hand instrument plate 15 from his/her position.

For use in the first position with corresponding easy access to the hand instrument plate 15 a support therefor may further be mounted at the front of the working table 6 as shown in FIG. 3.

For use in sole working also other accessories, for instance a light box for studying X-ray pictures and a holder for a suction hose, may be mounted on the upper cabinet, e.g. at its ends.

As it will best appear from FIG. 3 the working table 6 is supported on a pedestal 16, thereby avoiding table legs at the front of the work table.

The working table 6 may, as explained in the following, be combined with arbitrary other stationary devices in the clinic room.

I claim:

1. A dental working stand comprising a patient support;

a first dentist working position at a first side of said patient support;

a dental nurse working position substantially opposite said dentist working position at a second opposing side of said patient support;

a stationary dental nurse working table located at said second side of said patient support with a front side facing said dental nurse working position;

said working table including a lower cabinet and an upper cabinet wherein said lower and upper cabinets are pivoted about individual vertical axes, each between a first position in which a front side of said cabinets face said dental nurse working position and a second position in which said front side of the cabinets face a second dentist working position at an end of said patient support;

said lower cabinet is aligned in said first and second positions with said front side of said working table and an end of the working table facing said second dentist working position respectively and in both positions said lower cabinet is located within the boundaries of said working table.

2. A dental working stand as claimed in claim 1 wherein the lower cabinet has a substantially square basic form and an axis of rotation of the lower cabinet is located substantially at one rearmost corner of the cabinet at a distance from the front side of the working table and from said end corresponding to a side length of the lower cabinet.

3. A dental working stand as claimed in claim 1, wherein the upper cabinet has a smaller length and width than the working table and has an axis of rotation located in a central area of an end of said upper cabinet and so that the front of the upper cabinet in said first position is retracted with respect to the front of the working table, and in the second position it is retracted with respect to said end of the working table.

4. A dental working stand claimed in claim 3, wherein the axis of rotation of the upper cabinet is located in a central area between the front and back of the working table.

5. A dental working stand as claimed in claim 3, wherein the axis of rotation of the upper cabinet is located at an end of a podium forming a back wall of the working table between a tabletop and the upper cabinet in said first position.

6. A dental working stand as claimed in claim 1, further comprising a holder for a hand instrument table or plate to be used in said second position mounted at an end of the upper cabinet.

* * * * *